US009683377B1

(12) United States Patent
Eisinger et al.

(10) Patent No.: US 9,683,377 B1
(45) Date of Patent: Jun. 20, 2017

(54) CROWN MOLDING HANGER

(71) Applicants: Darren P. Eisinger, Carpentersville, IL (US); Geoffrey W. Neubauer, Chicago, IL (US)

(72) Inventors: Darren P. Eisinger, Carpentersville, IL (US); Geoffrey W. Neubauer, Chicago, IL (US)

(73) Assignee: Nomis LLC, Palatine, IL (US)

( * ) Notice: Subject to any disclaimer, the term of this patent is extended or adjusted under 35 U.S.C. 154(b) by 0 days.

(21) Appl. No.: 15/048,234

(22) Filed: Feb. 19, 2016

(51) Int. Cl.
*E04F 19/04* (2006.01)

(52) U.S. Cl.
CPC ..... *E04F 19/0463* (2013.01); *E04F 19/0436* (2013.01); *E04F 19/0486* (2013.01)

(58) Field of Classification Search
CPC ... E04F 21/1855; E04F 21/00; E04F 21/0069; E04F 19/0463; E04F 19/0436; E04F 19/0486
See application file for complete search history.

(56) References Cited

U.S. PATENT DOCUMENTS 368,574 A * 8/1887 Eby ..... E04F 21/1855 33/647
2,920,853 A * 1/1960 Bufogle ..... E03D 1/33 108/49
4,070,013 A * 1/1978 Sickler ..... E04F 21/1855 24/517
8,157,228 B2 4/2012 Smith
2001/0034952 A1* 11/2001 Mansfield ..... E04F 21/1855 33/647
2008/0106021 A1* 5/2008 Simko ..... E04F 21/1855 269/289 R
2014/0265095 A1 9/2014 Gaeta

OTHER PUBLICATIONS

Crown Molding Clip—FastCap—Woodworking Tools; date last visited May 18, 2016; 2 pages.; https://www.fastcap.com/estore/pc/viewprd.asp?idproduct=291.
Crown Control—FastCap—Woodworking Tools; date last visited May 18, 2016; 2 pages; https://www.fastcap.com/estore/pc/viewPrd.asp?idproduct=53740&idcategory=0.

* cited by examiner

*Primary Examiner* — James Ference
*Assistant Examiner* — Charissa Ahmad
(74) *Attorney, Agent, or Firm* — Reinhart Boerner Van Deuren P.C.

(57) ABSTRACT

A crown molding hanger is provided. The crown molding hanger can be used to install a piece of crown molding requiring only the time and effort of a single craftsman. The crown molding hanger has a mounting member and a support member. The support member is removably coupled to the mounting member. In use, the mounting member is coupled to a surface via a coupler and then the support member is removably coupled to the mounting member. The support member has a support surface that engages and holds a length of crown molding while the coupler secures the mounting member, support member, and length of crown molding. The crown molding hanger can be reused many times while leaving no visible blemish to the wall during the typical installation process of a piece of crown molding using the crown molding hanger.

20 Claims, 7 Drawing Sheets

CROWN MOLDING HANGER

FIELD OF THE INVENTION

This invention generally relates to tools for use by a craftsman and more particularly for supporting a piece of crown molding whereby a single craftsman can install the piece of crown molding to a surface.

BACKGROUND OF THE INVENTION

As crown molding is typically installed adjacent ceilings, which are typically 8 feet tall or higher, and the crown molding may be long and awkward to hold by a single craftsmen, it has long been required that the process of installing a piece of crown molding to be a job that requires the time and expertise of two craftsmen. The first craftsman will fit and nail the left end of a piece of crown molding and a second craftsman will fit and nail the right end of a piece of crown molding. Then after the left and right sides of the piece of crown molding have been secured to the ceiling, the craftsmen will work their way towards the center of the piece of crown molding while fitting and nailing the crown molding along the way.

BRIEF SUMMARY OF THE INVENTION

One objective of the crown molding hanger disclosed in the present application is to provide a tool that can be used repeatedly by a craftsman to install a multitude of crown molding pieces.

Another objective is to provide a crown molding hanger that allows a single craftsman to install a piece of crown molding, thereby, cutting the time and man-hours traditionally required to install crown molding.

Another objective it to provide a crown molding hanger that is safe to use and does not leave any visible blemishes on the wall during the installation of crown molding.

Another objective is to provide a crown molding hanger that is relatively inexpensive and does not require additional tools beyond those normally used to hang pieces of crown molding.

The invention provides such a crown molding hanger. These and other advantages of the invention, as well as additional inventive features, will be apparent from the description of the invention provided herein.

In one aspect the invention provides a crown molding hanger having a mounting member defining an attachment feature. The attachment feature is configured for attaching the mounting member to an attachment mechanism secured to and extending outward from a wall that secures the mounting member to the wall. The crown molding hanger further comprising a crown molding support member pivotably attached to the mounting member. The crown molding support member pivoting between a support position where the crown molding support member vertically supports a portion of a piece of crown molding and a released position. The crown molding hanger further comprising, a latch arrangement between the mounting member and the crown molding support member that is transitionable between a latched state and an unlatched state. When the latch arrangement is in the latched state, the latch arrangement prevents the crown molding support member from transitioning from the support position to the released position.

In another aspect, the invention provides a crown molding hanger having a support member with a support surface that is non-parallel to the mounting member when the support member and mounting member are in the latched state.

In yet another aspect, a crown molding hanger where the angle between the support surface and the mounting member is between 35° and 65°.

According to yet another aspect, a crown molding hanger where the latch arrangement has flanges that are parallely extending relative to the mounting member. The mounting member has coupling apertures extending through the mounting member and the flanges of the latch arrangement are removably coupleable to a coupling surface located adjacent to the periphery of the coupling apertures.

In yet still another aspect, a crown molding hanger where the width of the support member is between 1" and 2" and the length of the support member is between 1.75" and 3.75".

According to another aspect of the invention, a crown molding hanger having an attachment feature that includes an attachment notch. The attatchment feature forms a hook for engaging the attachment mechanism where the attachment notch defines a mouth that is formed in a side of the mounting member.

According to still yet another aspect, a crown molding hanger where the mounting member and the support member are composed of ABS plastic.

In yet another aspect, a crown molding hanger where the latch arrangement has a body with a flange and an abutment surface. The latch arrangement being in the latched state when the flange is engaged with the abutment surface and the latch arrangement being in the unlatched state when the flange is disengaged with the abutment surface.

According to another aspect, a method of using a crown molding hanger to hang a piece of crown molding comprising attaching an attachment mechanism to a mounting surface to which a piece of crown molding is to be attached. Further comprising the step of, attaching the attachment feature of the crown molding hanger to the attachment mechanism. Further comprising, the step of securing the crown molding to the mounting surface with the mounting member located between the wall and the crown molding and the crown molding hanger in the support position with the crown molding being supported, at least in part, by the crown molding hanger. Further comprising the steps of, unlatching latch arrangement and transitioning the support member from the support position to the released position. Further comprising the steps of, disconnecting the attachment feature from the attachment mechanism and sliding the mounting member along the wall to remove the mounting member from between the crown molding and the wall while the crown molding remains secured to the wall.

According to another aspect of the prevent invention, a method of using a crown molding hanger to hang a piece of crown molding comprising the step of, assembling the crown molding hanger by coupling a coupling member of a support member with a coupling surface of a mounting member, whereby the support member is pivotable relative to the mounting member.

According to yet another aspect of the present invention, a method of using a crown molding hanger to hang a piece of crown molding comprising the step of positioning a piece of crown molding between a mounting member and a support member with the support member being in the support position and the latch arrangement in the latched state.

According to yet another aspect of the present invention, a method of using a crown molding hanger to hang a piece of crown molding comprising the step of unlatching the latch arrangement which includes disengaging a first abutment forming a part of the mounting member from a second abutment forming a part of the support member.

According to yet another aspect of the present invention, a method of using a crown molding hanger to hang a piece of crown molding comprising the step of transitioning the support member from the support position to the released position which includes rotating the support member about a rotational axis from the support position to the released position such that the support member is no longer adjacent the crown molding.

According to yet another aspect of the present invention, a method of using a crown molding hanger to hang a piece of crown molding comprising the step of disengaging the first abutment from the second abutment which is performed by bending a flexible leg including one of the first or second abutments such that the first and second abutments no longer engage.

According to yet another aspect of the present invention, a method of using a crown molding hanger to hang a piece of crown molding, wherein the step of unlatching the latch arrangement includes disengaging a first set of first and second abutments and disengaging a second set of first and second abutments by squeezing a pair of legs toward one another, one of the abutments of the first set of abutments being provided by the first leg and one of the abutments of the second set of abutments being provided by the second leg.

According to yet another aspect of the present invention, a method of using a crown molding hanger to hang a piece of crown molding, wherein the attachment feature has a hook shape such that disconnecting the attachment feature from the attachment mechanism requires sliding the mounting member both vertically upward and horizontally.

According to yet another aspect of the present invention, a method of using a crown molding hanger to hang a piece of crown molding, wherein the mounting member includes an inwardly extending cutout portion that terminates in the mounting aperture.

According to yet another aspect of the present invention, a method of using a crown molding hanger to hang a piece of crown molding, wherein the support member has a base mounting member and the mounting member has a base receiving member. The base mounting member being engaged by the base receiving member to pivotably attach the support member to the mounting member.

According to yet another aspect of the present invention, a method of using a crown molding hanger to hang a piece of crown molding, wherein the support member has a coupling bar having positioning members and contact surface members. The base member has j-hooked receiving members having a receiving surface and the engagement of the contact surface members of the support bar with the j-hooked receiving surface pivotably coupled the support member to the mounting member.

According to yet another aspect of the present invention, a method of using a crown molding hanger to hang a piece of crown molding, wherein the support member has clearance apertures that provide clearance for the j-hooked receiving members when the support member is pivotably moved relative to the mounting member.

According to yet another aspect of the present invention, a method of using a crown molding hanger to hang a piece of crown molding, wherein the mounting member has clearance cutouts that provide clearance to the positioning members of the support member.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 6 B is a front perspective partial cross-sectional view of the crown molding hanger of FIG. 6 A further illustrating the support member removably coupled with the mounting member;

DETAILED DESCRIPTION OF THE INVENTION

Figure 1:
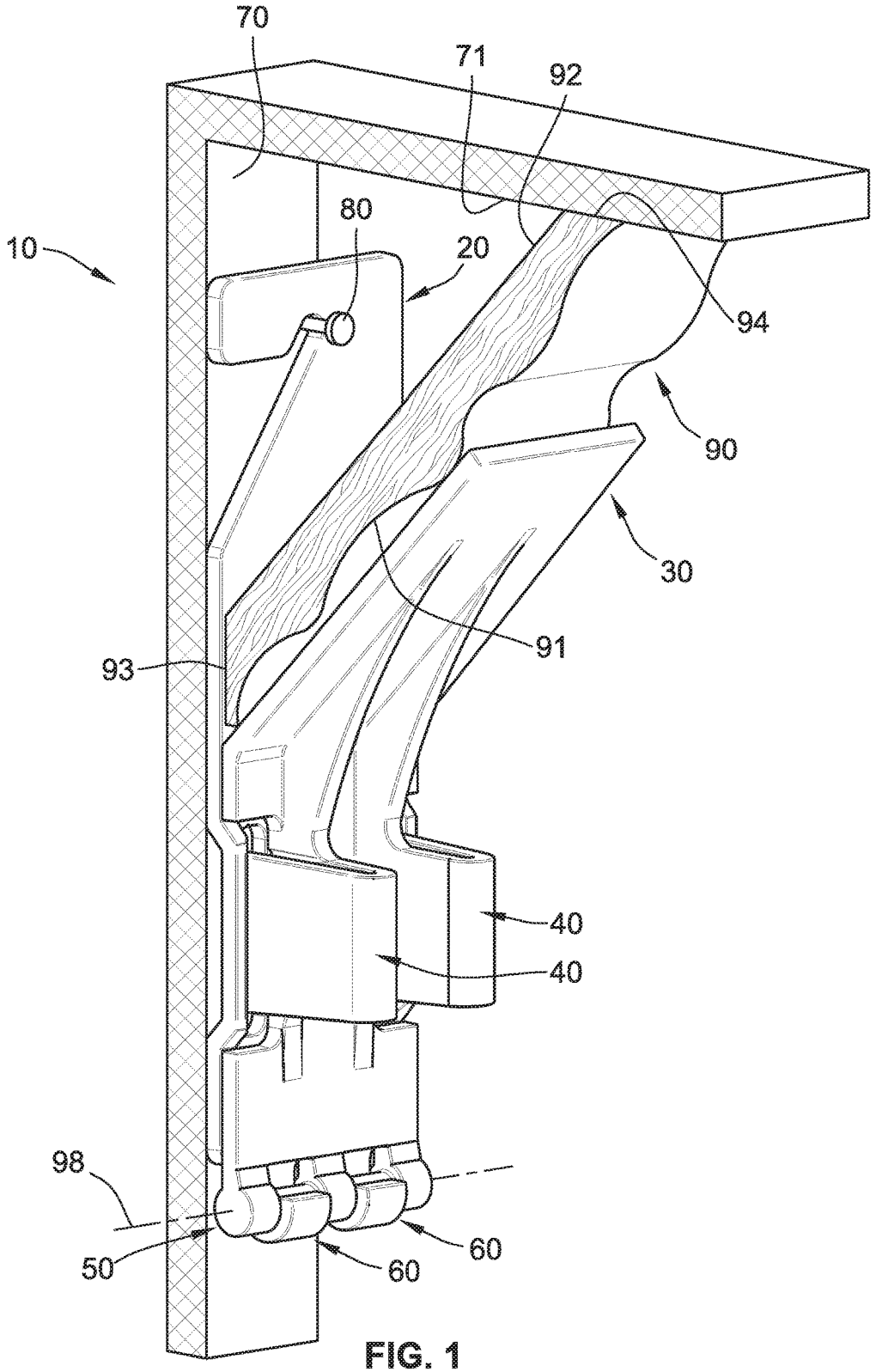
FIG. 1 is a perspective view of one embodiment of a crown molding hanger according to one aspect of the present application supporting a piece of crown molding.

Referring now to the drawings, FIG. 1 illustrates a perspective view of one embodiment of a crown molding hanger 10 according to one aspect of the present application. Further illustrated is a piece of crown molding 90 shown being held in the installation position by the crown molding hanger 10.

As will be readily understood by those of ordinary skill in the art, a typical piece of crown molding 90 has a first and second long surface 91 and 92 and a first and second short surface 93 and 94. The two long surfaces 91 and 92 are generally on opposing sides and extend between the two short surfaces 93 and 94. The two short surfaces 93 and 94 typically extend at 90° angles relative to one another to facilitate mounting the crown molding 90. As will further be appreciated by one of ordinary skill in the art, the typical installation of a piece of crown molding 90 will have the first short surface 93 attached to a first mounting surface 70 (e.g. a wall) and the second short surface 94 attached to a second mounting surface 71 (e.g. a ceiling). However, other installations may have only the first or second short surfaces 93 and 94 attached to the first mounting surface 70 or the second mounting surface 71.

The crown molding hanger 10 of the present application acts to aid a user during the installation of a piece of crown molding 90 by securing and supporting a piece of crown molding 90 in the proper installation position, which frees the user from having to hold the piece of crown molding 90 while trying to simultaneously attach the first short surface 93 to the first mounting surface 70 and the second short surface 94 to the second mounting surface 71.

Figure 2:
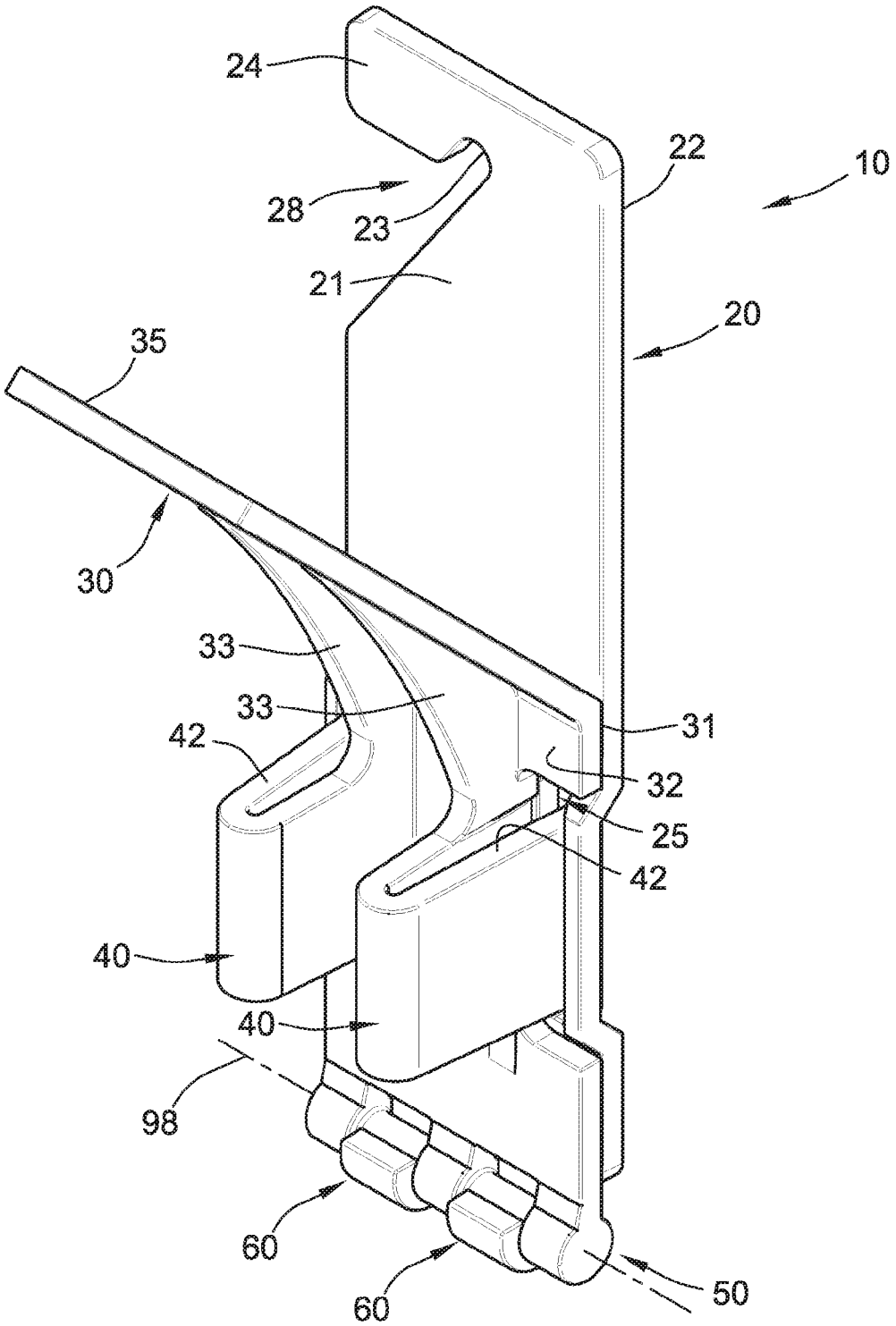
FIG. 2 is a front perspective view of one embodiment of a crown molding hanger according to one aspect of the present application.
Figure 3:
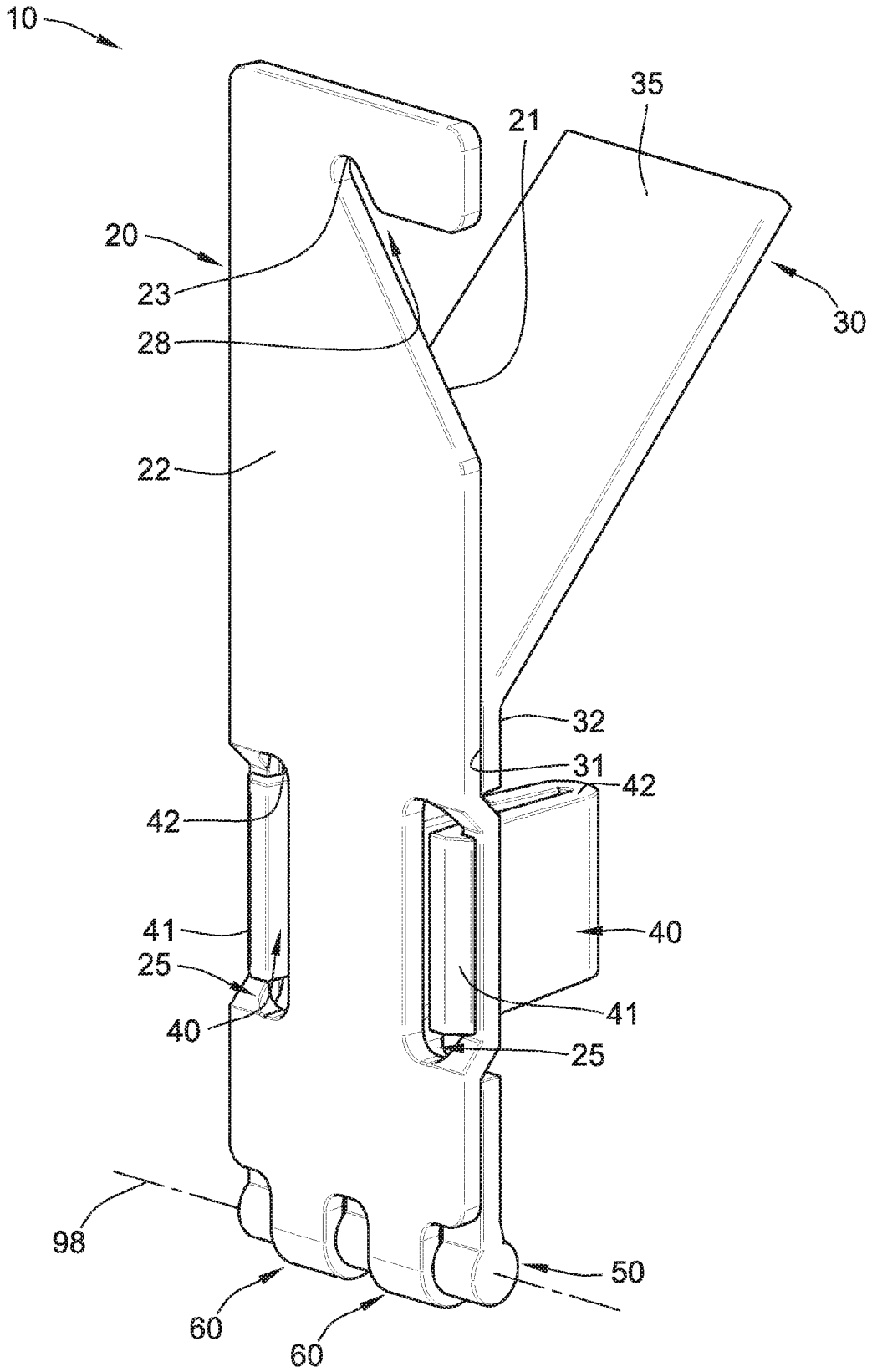
FIG. 3 is a back perspective view of the crown molding hanger of FIG. 2.

Referring to FIGS. 2-3, a front perspective view and a back perspective view of an exemplary embodiment of a crown molding hanger 10 according to the present application are illustrated. The crown molding hanger 10 has a mounting member 20 and a support member 30. The mounting member 20 has a first surface 21 and a second surface 22.

Further, in the illustrated exemplary embodiment, the mounting member 20 has a notch 23 and a hooked shaped mounting flange 24 that are made by cutting out a portion of the mounting member 20. As illustrated in FIG. 1, the notch 23 receives the attachment mechanism 80, which supports the mounting member 20. Furthermore, the hooked shaped mounting flange 24 prevents the inadvertent dislodgment of the mounting member 20 from the attachment mechanism 80.

In the illustrated embodiment, the mounting member 20 also has a cutout section 28, which provides access to the notch 23. As will be appreciated by one having ordinary skill in the art, the cutout section 28 allows a user to first couple the attachment mechanism 80 to the first mounting surface 70 and then position the attachment mechanism 80 into the notch 23 via the clearance provided by the cutout section 28.

Furthermore, as best illustrated in FIG. 1, during the installation of a piece of crown molding 90 using the crown molding hanger 10, the attachment mechanism 80 can be inserted into the first mounting surface 70 at a location that will be covered by the piece of crown molding 90. Once the attachment mechanism 80 is installed, the cutout section 28 allows the for the mounting member 20 to be removed from the attachment mechanism 80 by sliding the mounting member 20 along the first mounting surface 70. As the mounting member 20 is slid parallel to the first mounting surface 70 (in a left to right direction and slightly bottom to top in FIG. 1) the attachment mechanism 80 exits the notch 23 and then the cutout section 28, whereby, the attachment mechanism 80 is no longer supporting the mounting member 20 and keeping the mounting member 20 coupled to the first mounting surface 70. The user can then slide the mounting member 20 along the first mounting surface 70 (in a top to bottom direction of FIG. 1) until the first short surface 93 of the piece of crown molding 90 is no longer contacting the mounting member 20 and the mounting member 20 is no longer located between the first mounting surface 70 and the first short surface 93. The mounting member 20 can then be used at another location to install another piece of crown molding 90.

Further, as will be understood by those having ordinary skill in the art, many, but not all, attachment mechanism 80, such as nails, screws, bolts, etc. leave holes or other imperfections in the wall even after their removal, which takes time and effort to repair. Thus, one of the advantages of the crown molding hanger 10 of the present application is that ability to insert the attachment mechanism 80 into a part of the first mounting surface 70, which will never be seen after the installation of the crown molding 90. Therefore, the user does not have to expend the time and effort to fix blemishes created by the insertion of the attachment mechanism 80 into the first mounting surface 70 because the portion of the first mounting surface 70 that the attachment mechanism 80 is inserted into is covered by the installed piece of crown molding 90.

Figure 4:
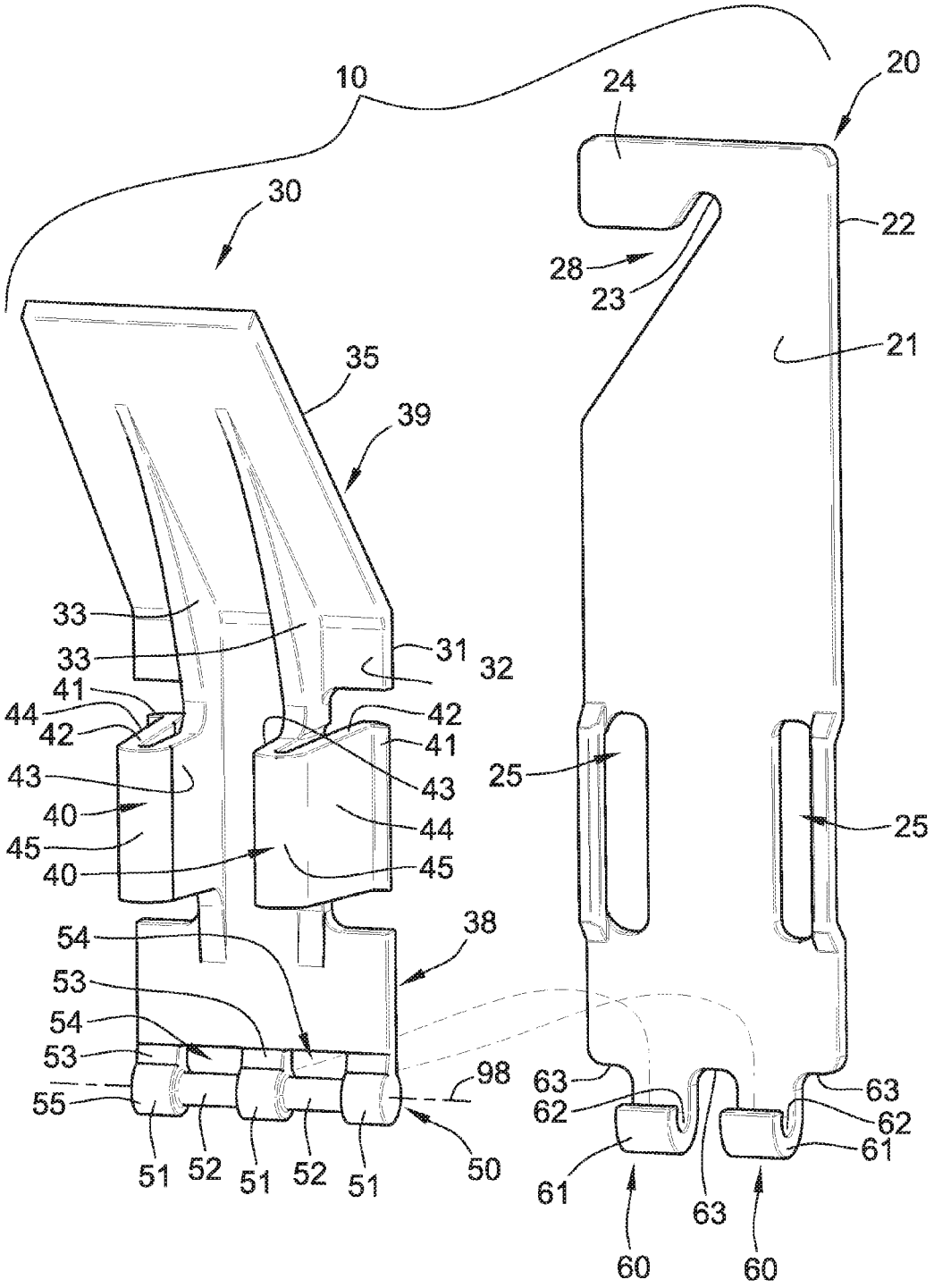
FIG. 4 is a front exploded perspective view of one embodiment of a crown molding hanger further illustrating the support member decoupled from the mounting member.
Figure 5:
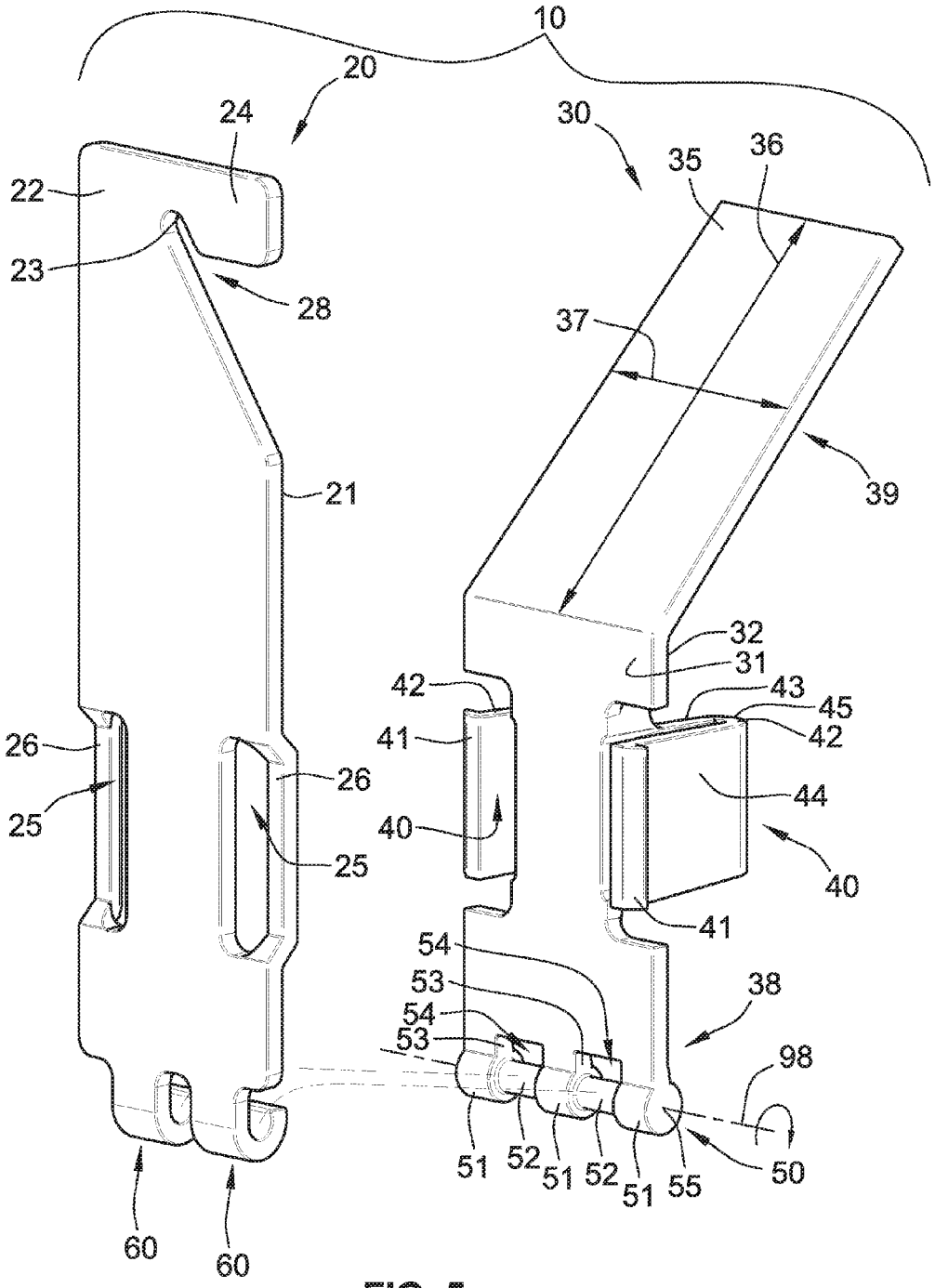
FIG. 5 is a back exploded perspective view of the crown molding hanger of FIG. 4 further illustrating the support member decoupled from the mounting member.

Referring now to FIGS. 4-5, the support member 30 has a first surface 31 and a second surface 32. With reference to FIG. 5, the first surface 31 has a contact surface 35 that is non-parallel to the mounting member 20 when the support member 30 is removably coupled to the mounting member 20. The contact surface 35 typically has a length 36 in the range between 1" and 7" and a width 37 between 0.25" and 6". However, in one exemplary preferred embodiment, the contact surface 35 has a length 36 in the range between 1.75" and 3.75" and a width 37 between 1" and 2".

As illustrated in FIG. 4, the second surface 32 of the support member 30 has braces 33 that are integrally formed with the support member 30. As will be appreciated by one having ordinary skill in the art, the braces 33 provide structural support to the support structure 30, and particularly to the portion that defines the support surface 35, when the crown molding hanger 10 is holding a piece of crown molding 90, as illustrated in FIG. 1.

Further, the crown molding hanger 10 has a latch arrangement 40 for operably securing the support member 30 in a support position relative to the mounting member 20. The latch arrangement 40 is provided between and by the support member 30 and mounting member 20.

In the exemplary embodiment, the latch arrangement 40 has a pair of bodies 42. Each body 42 has a first leg 43 that extends outward from the second surface 32 of the support member 30. The body then has a curved portion 45 that curves substantially 180° (e.g. ±10°). The body 42 then has a second leg 44 that extends back and beyond the first surface 31 of the support member 30. The second leg 44 then terminates into a flange 41 that is parallely extending relative to the first and second surfaces 31 and 32 of the support member 30 and which is generally perpendicular to legs 43 and 44 of the body 42.

Referring now to FIGS. 4-5, the mounting member 20 also has receiving apertures 25 extending through the mounting member 20, which form part of the latch arrangement. Further, as best illustrated in FIG. 5, the second surface 22 of the mounting member 30 has a first abutment surface 26 located adjacent to each receiving aperture 25. In the exemplary embodiment, the first abutment surfaces 26 are designed to engage the flanges 41 of the first coupling member 40 when the support surface 30 is removably coupled to the mounting member 20, as illustrated in FIGS. 2-3.

Further illustrated in FIGS. 4-5 is a base coupling member 50 that in the illustrated embodiment is integral with the support member 30. The base coupling member 50 has tabs 53 that extend to a coupling bar 55. The tabs 52 are spaced apart to provide clearance apertures 54 which extend through the mounting member 20. The coupling bar 55 has enlarged positioning members 51 and smaller coupling surface members 52 that are distributed between the positioning members 51 of the coupling bar 55.

Referring now to the embodiment of the mounting member 20, as illustrated in FIGS. 4-5, the mounting member 20 includes a base receiving members 60. In the illustrated embodiment, the base receiving members 60 have j-hook receiving members 61 that contain contact surfaces 62 that define upward facing troughs for receiving the coupling surface members 52 to connect the mounting member 20 and the support member 30. The j-hook receiving members 61 extend from the mounting member 20 and are located adjacent to pivoting cutouts 63 that extend through and between the mounting member 20.

Figure 6B:
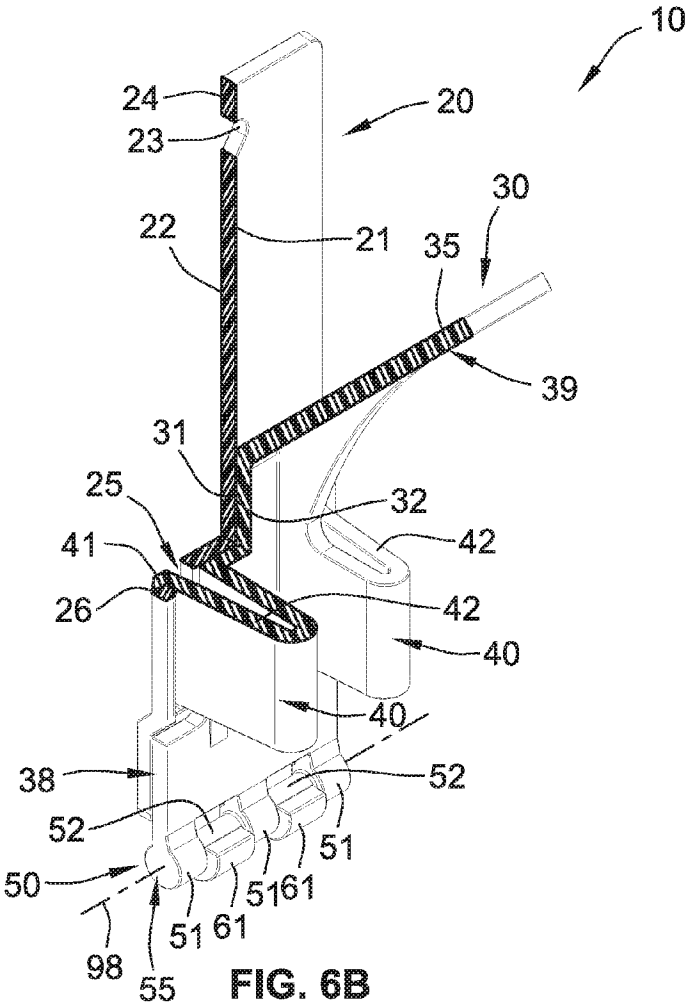
FIG. 6 A is a front perspective partial cross-sectional view of one embodiment of a crown molding hanger further illustrating the support member in the process of being coupled with the mounting member.
Figure 6A:
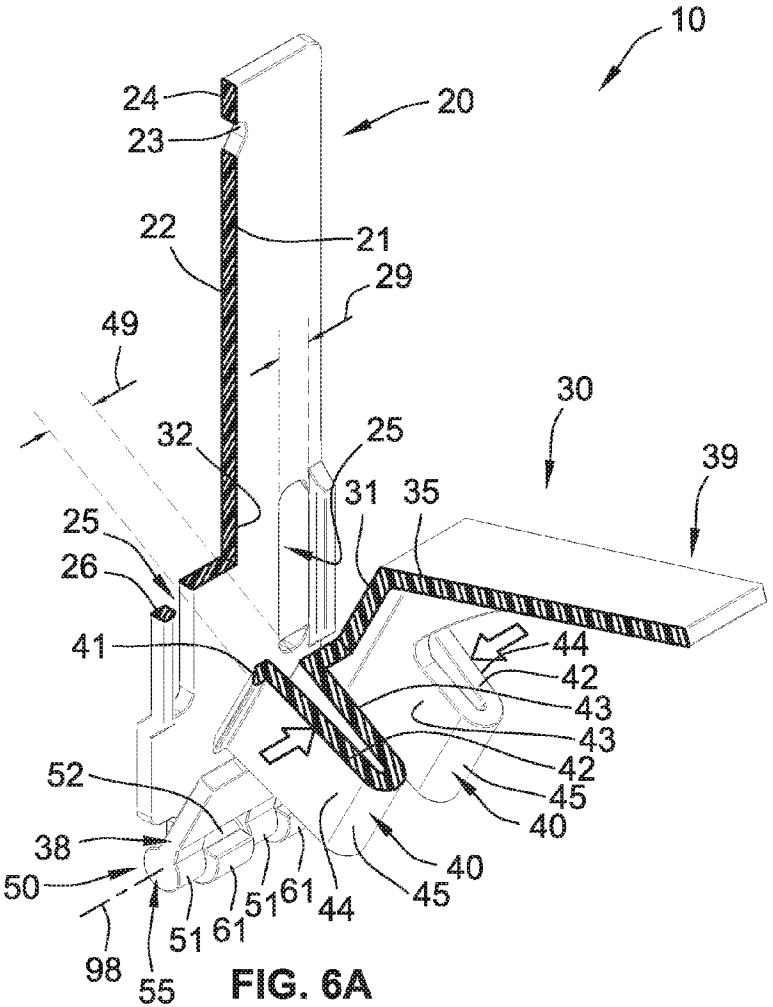

FIGS. 6A and 6B, illustrate an exemplary embodiment of a support member 30 and mounting member 20 of a crown molding hanger 10 according to one aspect of the present application with the support member 30 being removably coupled to the mounting member 20.

With additional reference to FIG. 1, in operation, the user will insert an attachment mechanism 80 into a first mounting surface 70. Then, the user will position the mounting member 20 adjacent to the attachment mechanism 80 such that the attachment mechanism 80 can enter the cutout 28 of the mounting member 20 and be positioned to sit within the notch 23 of the mounting member 20. Once the attachment mechanism 80 is sitting within the notch 23, the user may release the mounting member 20 because the attachment mechanism 80 is vertically supporting the mounting member 20 and keeping it in place on the first mounting surface 70.

As illustrated in FIG. 6A, typically when a user is ready to removeably couple the support member 30 to the mounting member 20, the user will first align the base coupling member 50 of the support member 30 with the base receiving member 60 of the mounting member 20, such that the coupling surface members 52 are located in the troughs of the corresponding receiving surfaces 62 (see FIG. 4) of the base receiving members 60.

Once the user has aligned the coupling surface members 52 with receiving surfaces 62, the user can then apply a slight axial force to the support member 30 which will cause the surface members 52 to become engaged and secured along the interior receiving surface 62 of the of the base receiving members 60. As will be understood by one of ordinary skill in the art, this step can also be performed before attaching the mounting member 20 to the attachment mechanism 80.

After the user has removably coupled the support member 30 to the mounting member 20, the support member 30 will be able to rotate, about a rotational axis 98 created by coupling the base coupling member 50 and the base receiving member 60.

The alignment members 51 of the coupling bar 55 prevent the improper engagement of the base coupling member 50 with the base receiving members 60. As the alignment members 51 have a diameter that are larger than the diameter of the coupling surface members 52, the user will only be able to complete the coupling between the base coupling member 50 and the base receiving member 60 if the coupling surface members 52 are properly aligned with the receiving surfaces 62. Thus, a degree of human error is eliminated from the assembly process of the crown molding hanger 10.

After the user has coupled the support member 30 to the mounting member 20, the user will be able to pivot the support member 30 towards the mounting member 20 about rotational axis 98 and transition the crown molding hanger 10 from an unlatched state to a latched state.

The pivoting cutouts 63 of the mounting member 20 provide clearance for the positioning members 51 of the coupling bar 55 when the support member 30 is pivoted while coupled to the mounting member 20. Likewise, the clearance apertures 54 of the support member 30 provide clearance for the j-hook receiving members 61 during the pivoting of the support member 30 relative to the mounting member 20.

To move the crown molding hanger 10 from the unlatched state to the latched state, the user will need to pivot the support member 30 about the axis of rotation 98 toward the mounting member 20, such that the components of the latch arrangement 40 can engage.

In the exemplary embodiment, to move the crown molding hanger 10 from the unlatched state to the latched state, the user will pivot the support member 20 toward the mounting member 20 such that the leg 44 and the flange 41 of the latch arrangement 40 are inserted through the receiving apertures 25 of the mounting member 20 and engage the first abutment surface 26 located on the second surface 22 of the mounting member 22. It is noted that the portions of the mounting member 20 that provide the abutment surface 26 are offset from a main portion of the mounting member 20 to provide clearance for the flanges 41 to engage the abutment surfaces 26.

In the exemplary illustrated embodiment, the receiving apertures 25 of the mounting member 20 are spaced and located such that they have a resting width 49 that is larger than the width 29 of the receiving apertures 25. In order to lath the latch arrangement 40, the user will need to apply pressure (see arrows in FIG. 6 A) to the second leg 44 of the body 42 in a direction towards the first leg 43 to latch and unlatch the latch arrangement 40. As a user applies pressure to the second leg 44, the second leg 44 shifts closer to the first leg 43 causing the body 42 to deform such that the width of the body 42 is compressed to a width that is less than the resting width 49 of the body 42 and less than the width 29 of the receiving apertures 25. After the body 42 has been compressed to a width less than the width 29 of the receiving apertures 25, the body 42 can be at least partially entered into the receiving aperture 25.

Once leg 42 and flange 41 have entered the receiving apertures 25 of the mounting member 20, the user can relieve the pressure being applied to the second leg 44 of the body 42, which will cause the body 42 to return to its resting width 49, whereby the flange 41 of the body 42 will engage with the first abutment surface 26 of the mounting member 20. After the flange 41 has engaged with the first abutment surface 26, the support member 30 will no longer be capable of pivoting relative to the mounting member 20 about rotational axis 98, at which point the crown molding hanger 10 will have entered the latched state.

The crown molding hanger 10 can transition from the latched state back to the unlatched state by applying pressure on second leg 44 of the body 42 to compress the body 42. This disengages the flange 41 from the first abutment surface 26, such that the support member 30 can be pivoted about rotational axis 98 in a direction away from the mounting member 20. At this point, the crown molding hanger 10 transitions from the latched state to the unlatched state.

Likewise, once the crown molding hanger 10 has entered the unlatched state, the support member 30 can be completely removed from the mounting member 20 by applying a slight linear force on the support member 30 in a direction away from the base receiving member 60, which will cause the coupling surface members 52 to disengage with the receiving surface 62, which will cause the base coupling member 50 to disengage the base receiving member 60, which will completely disengage the support member 30 from the mounting member 20.

In addition, as will be appreciated by one having ordinary skill in the art, the latch arrangement 40 of the crown molding hanger 10 is designed so that a typical user will be able to compress either side of the legs 44 of the body 42 with one hand. This allows the user to transition the crown molding hanger 10 between the latched state and unlatched state with only one hand free. As will further be appreciated by one of ordinary skill in the art, this allows a single user to simultaneously position the piece of crown molding 90 in its installation position (see FIG. 1) while at the same time transitioning the crown molding hanger 10 from the unlatched state to the latched state and vice versa. Thus, the crown molding hanger 10 of the present application provides an efficient and effective way for a single user to simultaneously position and secure a piece of crown molding 90 into its installation position, as illustrated in FIG. 1.

The ability to disengage the support member 30 from the mounting member 20 allows the user to easily store the crown molding hanger 10 in places with limited dimensions, such as a tool-box.

Further, the ability to disengage the support member 30 from the mounting member also allows a user to use a single mounting member 20 with a multitude of support members 30 or a multitude of mounting members 20 with a single support member 30. For example, a user may use the same mounting member 20, but have the option to select one support member 30 having one length 36 and width 37 for a larger piece of crown molding 90 and a second support member 30 having another length and width 37 for a smaller piece of crown molding 90. Likewise, a user may use the same support member 30, but select one mounting member 20 because one piece of crown molding 90 has a smaller weight and to select a second mounting member 20 for a second piece of crown molding 90 that has a larger weight.

In some applications, the user may want to first position the second short surface 93 of the piece of crown molding 90 against the first surface 21 of the mounting member 20 and the first short surface 92 of the piece of crown molding 90 against the second mounting surface 71 before pivoting the support member 30 about the axis of rotation 98 toward the mounting member 20 where the first long surface 91 of the piece of crown molding 90 will make contact with and thereby support the piece of crown molding 90.

In such applications, the user will first position the piece of crown molding 90 between the support member 30 and the mounting member 20 before pivoting the support member 30 about the axis of rotation 98 towards the mounting member 20. Once the user has positioned the piece of crown molding, the user can then pivot the support member 30 about the axis of rotation 98 towards the mounting member 20 until the latching arrangement 40 can transition the crown molding hanger 10 into the latched state where the contact surface 35 of the support member 30 will be engaged with the first long surface 91 of the piece of crown molding 90 and the first surface 21 of the mounting member 20 will be engaged with the first short surface 93 of the piece of crown molding 90. In this position, the crown molding hanger 10 will support the piece of crown molding 90 in its installation position, as illustrated in FIG. 1.

In other instances, the user may want to first transition the crown molding hanger 10 into its latched state and then position the piece of crown molding 90 between the support member 30 and the mounting member 20. In such instances, the user will simply couple the mounting member 20 to the first mounting surface 70 via an attachment mechanism 80 and then transition the crown molding hanger 10 into the latched state, whereby the support member 30 will be removably coupled to the mounting member 20 as described in detail above. Then the user can position the piece of crown molding 90 to enter between the support member 30 and the mounting member 20 of the crown molding hanger 10 that is in the latched state until the contact surface 35 of the support member 30 is engaged with the first long surface 91 of the piece of crown molding 90 and the first surface 21 of the mounting member 20 is engaged with the first short surface 93 of the piece of crown molding 90 and is in the proper installation position, as illustrated in FIG. 1.

Figure 7:
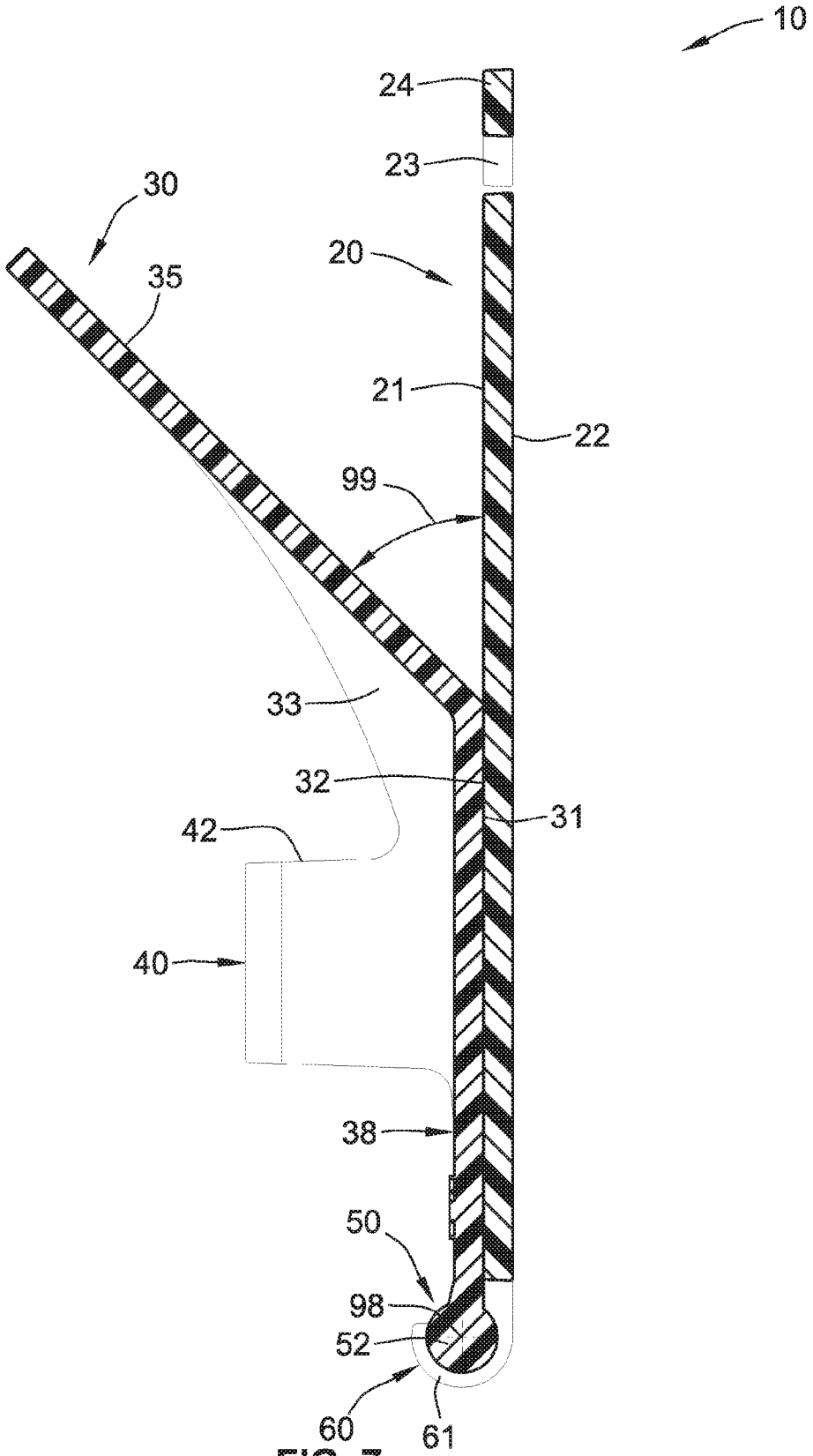
FIG. 7 is a cross-section of one embodiment of a crown molding hanger further illustrating the support member removably coupled with the mounting member; and While the invention will be described in connection with certain preferred embodiments, there is no intent to limit it to those embodiments. On the contrary, the intent is to cover all alternatives, modifications and equivalents as included within the spirit and scope of the invention as defined by the appended claims.

Referring now to FIG. 7 illustrating a side cross-sectional view of one embodiment of a crown molding hanger 10 in the latched state according to one aspect of the present application. As illustrated, when the crown molding hanger 10 is in the latched state an angle 99 is formed between the support surface 35 of the support member 30 and the first surface 21 of the mounting member 20.

In typical applications, the angle 99 created between the support surface 35 and the first surface 21 of the mounting member 20 will be between 25° and 70°. However, in one exemplary preferred embodiment the angle 99 between the support surface 35 and the first surface 21 of the mounting member 20 is between 35° and 65°.

Further, it is also envisioned that one embodiment of a crown molding hanger 10 could have a multitude of support members 30 that are each individually capable of coupling with a single mounting member 20. Each of the support members 20 form a different angle between the support surface 35 of the support member 30 and the first surface 21 of the mounting member 20 to accommodate different shaped pieces of crown molding 90.

Likewise, it is also envisioned that according to one embodiment of the present application, a crown molding hanger 10 whereby a multitude of support members 30 can be used with a multitude of mounting members 20, such that the crown molding hanger 10 can accommodate pieces of crown molding 90 having a variety of shapes, sizes, structural makeups, etc. For example, longer mounting member 20 could be provided for larger pieces of crown molding 90.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A crown molding hanger including:

a mounting member defining an attachment feature configured for operably attaching the mounting member to an attachment mechanism secured to and extending outward from a wall;

a crown molding support member pivotably attached to the mounting member the crown molding support member pivoting between a support position in which the crown molding support member vertically supports a portion of a piece of crown molding and a released position;

a latch arrangement between the mounting member and the crown molding support member that is transitionable between a latched state and an unlatched state, when the latch arrangement is in the latched state, the latch arrangement prevents the crown molding support member from transitioning from the support position to the released position;

a body located on the support member having a first leg outwardly extending from a first surface of the support member and a second leg extending back toward the first surface of the support member, wherein the second leg terminates in a flange that is generally parallel to the first surface of the support member;

the latching arrangement further comprising an abutment surface on a second surface of the mounting member, wherein the latch arrangement is in the latched state when the flange of the body is engaged with the abutment surface of the mounting member;

wherein the mounting member has a receiving aperture extending through the mounting member from a first surface of the mounting member to the second surface of the mounting member; and wherein the abutment surface is located proximally adjacent to the receiving aperture.

2. The crown molding hanger of claim 1, wherein the support member has a support surface that is non-parallel to the mounting member when the support member and mounting member are in the latched state.

3. The crown molding hanger of claim 2, wherein the angle between the support surface and the mounting member is between 35° and 65°.

4. The crown molding hanger of claim 1, wherein the latch arrangement has flanges that are parallely extending relative to the mounting member.

5. The crown molding hanger of claim 4, wherein the mounting member has coupling apertures extending through the mounting member;

wherein the flanges of the latch arrangement are removably coupleable to a coupling surface located adjacent to the periphery of the coupling apertures.

6. The crown molding hanger of claim 2, wherein the width of the support member is between 1" and 7" and the length of the support member is between 0.25" and 6".

7. The crown molding hanger of claim 1, wherein the attachment feature includes an attachment notch that forms a hook for engaging the attachment mechanism, the attachment notch defining a mouth that is formed in a side of the mounting member.

8. The crown molding hanger of claim 1, wherein the mounting member and the support member are composed of ABS plastic.

9. The crown molding hanger of claim 1, wherein the body has a decompressed width and a compressed width that is less than the decompressed width;

wherein the receiving aperture has a width that is less than the decompressed width of the body and greater than the compressed width of the body, such that the compressed width of the body can extend at least partially through the receiving aperture.

10. A method of hanging a piece of crown molding comprising:

providing a crown molding hanger having a mounting member defining an attachment feature configured for operably attaching the mounting member to an attachment mechanism secured to and extending outward from a mounting surface for securing the mounting member to the mounting surface;

wherein the crown molding hanger further comprises a support member pivotably attached to the mounting member to pivot between a support position in which the support member vertically supports a portion of a piece of crown molding and a released position;

a latch arrangement between the mounting member and the support member that is transitionable between a latched state and an unlatched state, when the latch arrangement is in the latched state, the latch arrangement prevents the support member from transitioning from the support position to the released position;

a attaching an attachment mechanism to the mounting surface to which the piece of crown molding is to be attached;

attaching the attachment feature of the crown molding hanger to the attachment mechanism;

securing the crown molding to the mounting surface with the mounting member located between the mounting surface and the crown molding and the crown molding hanger in the support position with the crown molding being supported, at least in part, by the crown molding hanger;

coupling the crown molding to the mounting surface;

unlatching the latch arrangement;

wherein the step of unlatching the latch arrangement includes disengaging a first abutment forming a part of the mounting member from a second abutment forming a part of the support member;

wherein disengaging the first abutment from the second abutment is performed by bending a flexible leg including one of the first or second abutments such that the first and second abutments no longer engage;

transitioning the support member from the support position to the released position;

disconnecting the attachment feature from the attachment mechanism; and sliding the mounting member along the mounting surface to remove the mounting member from between the crown molding and the mounting surface the while the crown molding remains secured to the mounting surface.

11. The method of claim 10, further comprising the step of:

assembling the crown molding hanger by coupling a coupling member of the support member with a coupling surface of the mounting member, whereby the support member is pivotable relative to the mounting member.

12. The method of claim 10, further comprising the step of:

positioning the piece of crown molding between the mounting member and the support member with the support member being in the support position and the latch arrangement in the latched state.

13. The method of claim 10, wherein the step of transitioning the support member from the support position to the released position includes rotating the support member about a rotational axis from the support position to the released position such that the support member is no longer adjacent the crown molding.

14. The method of claim 10, wherein the step of unlatching the latch arrangement includes disengaging a first set of first and second abutments and disengaging a second set of first and second abutments by squeezing a pair of legs towards one another, one of the abutments of the first set of abutments being provided by the first leg and one of the abutments of the second set of abutments being provided by the second leg.

15. The method of claim 10, wherein the attachment feature has a hook shape such that disconnecting the attachment feature from the attachment mechanism requires sliding the mounting member both vertically upward and horizontally.

16. The crown molding hanger according to claim 15, wherein the mounting member includes an inwardly extending cutout portion that terminates in a mounting aperture.

17. The crown molding hanger according to claim 10, wherein the support member has a base mounting member; and the mounting member has a base receiving member;

wherein the base mounting member is engaged by the base receiving member to pivotably attach the support member to the mounting member.

18. The crown molding hanger according to claim 15, wherein the support member has a coupling bar having positioning members and a contact surface member;

wherein the mounting member has a j-hooked receiving member having a receiving surface; and wherein the engagement of the contact surface member of the coupling bar with the j-hooked receiving surface pivotably couples the support member to the mounting member.

19. The crown molding hanger of claim 17, wherein the support member has clearance apertures that provide clearance for a i-hooked receiving member when the support member is pivotably moved relative to the mounting member.

20. The crown molding hanger of claim 17, wherein the mounting member has clearance cutouts that provide clearance to a positioning member of the support member.

* * * * *